US007541982B2

(12) United States Patent
Gillette

(10) Patent No.: US 7,541,982 B2
(45) Date of Patent: Jun. 2, 2009

(54) PROBE FED PATCH ANTENNA

(75) Inventor: Marlin R. Gillette, Brewerton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 192 days.

(21) Appl. No.: 11/713,914

(22) Filed: Mar. 5, 2007

(65) Prior Publication Data

US 2008/0218417 A1 Sep. 11, 2008

(51) Int. Cl.
*H01Q 1/38* (2006.01)

(52) U.S. Cl. ..... 343/700 MS; 343/840

(58) Field of Classification Search ..... 343/700 MS, 343/846

See application file for complete search history.

(56) References Cited

U.S. PATENT DOCUMENTS

| | | | | |
|---|---|---|---|---|
| 5,471,221 | A * | 11/1995 | Nalbandian et al. | 343/700 MS |
| 5,561,435 | A * | 10/1996 | Nalbandian et al. | 343/700 MS |
| 5,694,135 | A | 12/1997 | Dikun et al. | |
| 5,861,848 | A * | 1/1999 | Iwasaki | 343/700 MS |
| 6,184,833 | B1 | 2/2001 | Tran | |
| 6,380,895 | B1 | 4/2002 | Moren et al. | |
| 6,538,614 | B2 | 3/2003 | Fleming et al. | |
| 6,825,809 | B2 * | 11/2004 | Aoki et al. | 343/700 MS |
| 6,989,793 | B2 * | 1/2006 | Van Der Poel | 343/700 MS |
| 2007/0126638 | A1 * | 6/2007 | Channabasappa | 343/700 MS |

OTHER PUBLICATIONS

Soh et al., "Comparative Radiation Performance of Different Feeding Techniques for a Microstrip Patch Antenna", 2005 Asia-Pacific Conference on Applied Electromagnetics Proceedings, pp. 35-40, Dec. 20-21, 2005.

A.F. Peterson, "Analysis of Probe-Fed Circular Microstrip Patches Backed by Circular Cavities", Electromagnetics, 14, pp. 239-258, 1994.

W.Swelam et al., "Broad-Band U-Slot Rectangular Patch Antenna on a Microwave Substrate Using a Novel Feeding Technique", IEEE, pp. 533-536, 2005.

(Continued)

*Primary Examiner*—Tan Ho
(74) *Attorney, Agent, or Firm*—Howard IP Law Group, P.C.

(57) ABSTRACT

A microstrip antenna configuration employs a metallic patch which is positioned on the top surface of a dielectric substrate. The dielectric substrate has the bottom surface coated with a suitable metal to form a ground plane. A hole is formed through the ground plane, through the dielectric to allow access to the bottom surface of the patch. A center conductor of a coaxial cable is directly connected to the patch. The center conductor of the coaxial cable is surrounded by a metallic housing within the substrate area. The patch forms a first plate for the capacitance while the diameter of the outer housing of the coaxial cable within the substrate is increased to form another plate on the end of the coaxial cable. The value of capacitance can be adjusted by the area of the metallic housing the relative dielectric constant of the spacing material, and the spacing between the plates. The sum of the probe inductive impedance and microstrip patch antenna input impedance using the direct probe connection is adjusted and centered at a desired design center frequency and many such frequencies can be accommodated.

20 Claims, 7 Drawing Sheets

OTHER PUBLICATIONS

F. Zavosh and James T. Aberle, "Single and Stacked Circular Microstrip Patch Antennas Backed by a Circular Cavity", IEEE Transactions on Antennas and Propagation, vol. 43, pp. 746-750, No. 7, Jul. 1995.
Ghannoum et al., "Probe Fed Stacked Antenna for UWB Sectoral Applications", IEEE, pp. 97-102.
Mitchell et al., "Search for High-Performance Probe-Fed Stacked Patches Using Optimization", IEEE Transactions on Antennas and Propagation, vol. 51, pp. 249-255, No. 2, Feb. 2003.
Bahnacy et al., "Stacked L-Shaped Probe Fed Microstrip Antenna", IEEE, pp. 210-213, 2000.
International Search Report dated Jun. 5, 2008.
D. G. Fink et al., "Antennas and Wave Propagation," Chapter 18 of "Electronic Engineers Handbook 3rd Edition," McGraw-Hill, Inc., (1989), pp. 18-40-18-44.
G. Kumar & K.P. Ray, "Broadband Microstrip Antennas," AirTech House (2003), p. 62.
Luk, K. M., et al., "Broadband Microstrip Patch Antenna," Electronics Letters, vol. 34, 1998, pp. 1442-1443.
Mak, C. L., K. F. Lee, and K. M. Luk, "A Novel Broadband Patch Antenna with a T-shaped Probe," IEE Proc. Microwaves, Antennas Propagation, Pt. H, vol. 147, 2000, pp. 73-76.

* cited by examiner

PROBE FED PATCH ANTENNA

FIELD OF INVENTION

This invention relates generally to antenna configurations and more particularly to a probe-connected patch.

BACKGROUND

Microstrip patch antennas have several well known advantages over other antenna structures. These antennas generally have a low profile and conformal nature, are lightweight, have low production cost, are robust in nature and compatible with microwave monolithic integrated circuits (MMICs) and optoelectronic integrated circuits (OEICs) technologies. However, one drawback of such devices is their relatively narrow bandwidth. In order to achieve wider bandwidth, a relatively thick substrate must be used. However, the antenna substrate supports tightly bound surface wave modes which represent a loss mechanism in the antenna. The loss due to surface wave modes increases as the substrate thickness is increased. It is desirable to develop conformal microstip antennas which enjoy wide bandwidth, yet do not suffer from the loss of attractive features of the conventional microstrip patch antenna.

One way to reduce the element-to-element mutual coupling is to surround the patch elements with metal walls. This technique effectively prevents surface wave modes from being excited in a substrate, thus allowing the substrate's thickness to be increased without serious effects. In addition to the common techniques of increasing patch height and decreasing substrate permittivity, a conventional method uses parasitic patches in another layer (stacked geometry). However, this has the disadvantage of increasing the thickness of the antenna. Parasitic patches can also be used in the same layer (coplanar geometry); however, this undesirably increases the lateral size of the antenna and is not suitable for antenna array applications.

As previously mentioned, a disadvantage of microstrip patch antennas which has limited their use is due to their narrow bandwidth and to their inherent nature as resonant devices. Many efforts have been made to overcome such deficiencies, including the use of thick substrates, cutting slots in the metallic patch and introducing parasitic patches either on the same layer or on top of the main patch. Aperture coupled stacked patch antennas have also been investigated, however, such devices also have certain drawbacks.

In many applications, such as phased array radars, low profile antennas are required and bandwidths less than a few percent are acceptable. Therefore, microstrip antennas have many desirable features. The microstrip antenna is constructed on a thin dielectric sheet using printed circuit board and etching techniques. The most common board is a dual copper coated polytetrafluoroethylene (Teflon) fiberglass as it allows the microstrip antenna to be curved to conform to the shape of the mounting surface. The patch antenna itself may be square, rectangular, round, elliptical and the like. The two most common geometries, rectangular and round, are widely employed. Circular polarized radiation can be obtained by exciting the square or round element at two feed points 90° (degrees) apart and in quadrature phase. A direct probe connected patch antenna element which is suitable for application at low UHF frequencies is required for a phased array application. The impedance matching of such an antenna should be compact, mechanically simple, and take advantage of the volume occupied by the patch antenna element. In the prior art a broad band antenna element requires the use of thick substrates with low relative dielectric constants approaching that of air. The direct probe connection fixed substrate geometry has a long probe length constituting a series inductance which must be compensated to allow wideband impedance matching. The prior art has employed a series compensation technique where a series capacitor at the end of the probe is formed instead of a direct connection to the patch. A plate is connected to the probe and the surface forms one plate of a capacitor with the patch being the other plate. The proximity of the plate to the patch sets the capacitance to the desired value to create a series resonant circuit at the frequency of operation. Thus, the input impedance is conjugate impedance matched to a real value. This prior art which utilizes a series resonant circuit for probe compensation has no direct DC connection to the patch. The open circuited probe combined with a small plate forms the required capacitor for series resonance. Multiple substrate layers are used with the plate embedded between the layers. The plate is mechanically inserted between the substrate layers and DC connected to the probe. This is difficult to provide. Furthermore, the prior art devices and methods encounter difficulty in meeting required frequency response for many applications. Still further, such prior art antennas are susceptible to breakdown at high transmission powers.

SUMMARY OF THE INVENTION

The present antenna employs a configuration where no input electrical impedance matching structure in the input line is required. Thus the number of parts/drawings and associated lifetime costs for drawing support are reduced. The physical feed and element structures of the antenna according to an aspect of the invention substantially reduce the need for tight tolerances on all physical dimensions and corresponding dielectric material properties. Thus, the present antenna configuration reduces both element complexity and cost while improving manufacturability. The reduced mechanical/electrical complexity enables use of larger finite array structures in simulations using 3-dimensional (3D) electromagnetic simulation software.

A microstrip antenna configuration employs a metallic patch which is positioned on the top surface of a dielectric substrate. The dielectric substrate has the bottom surface coated with a suitable metal to form a ground plane. A hole is formed through the ground plane, through the dielectric to allow access to the bottom surface of the patch. A center conductor of a coaxial cable is directly connected to the patch. The center conductor of the coaxial cable is surrounded by a metallic housing within the substrate area. Thus, the probe length is reduced by retaining a coaxial transmission line within the substrate. The patch forms a first plate for the capacitance while the diameter of the coaxial cable outer housing within the substrate is increased to form another plate on the end of the coaxial cable. The value of capacitance can be adjusted by the area of the metallic housing, the relative dielectric constant of material between plates, and the spacing between the plates. The microstrip patch antenna input impedance using the direct probe connection is adjusted and centered at a desired center frequency and many such frequencies can be accommodated.

DETAILED DESCRIPTION OF THE PREFERRED EMBODIMENTS

Figure 1A:
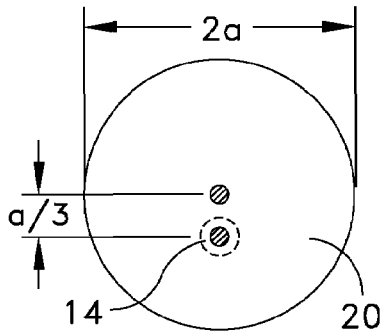
FIG. 1A (PRIOR ART)
FIG. 1 consists of FIGS. 1*a*, 1*b* and 1*c* and shows schematic diagrams of prior art coaxial microstrip antennas.
Figure 1B:
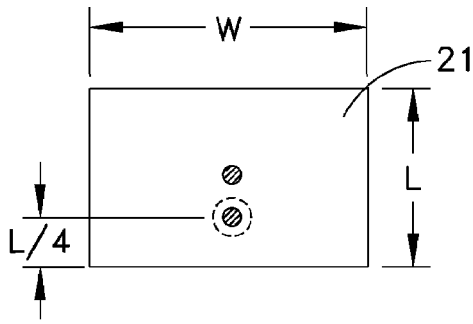
FIG. 1B (PRIOR ART)
Figure 1C:
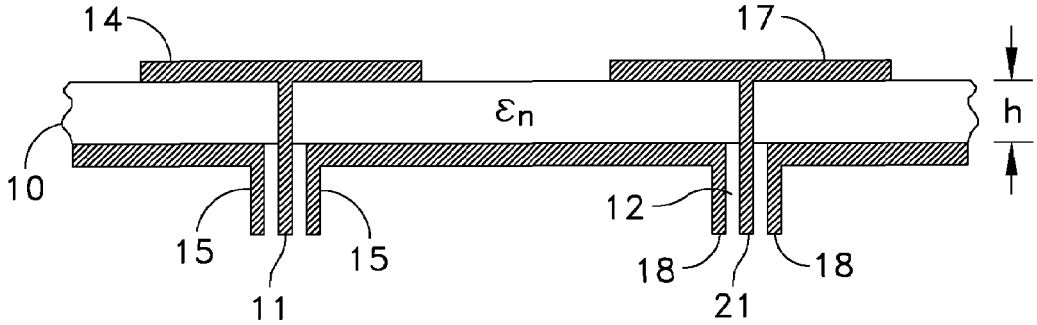
FIG. 1C (PRIOR ART)

Before proceeding with the description of the invention, reference is made to FIG. 1, which consists of FIGS. 1*a*, 1*b* and 1*c*. FIGS. 1*a*, 1*b* and 1*c* depict prior art coaxial fed microstrip antennas. Referring to FIG. 1*a*, there is shown a round or circular microstrip antenna, while FIG. 1*b* depicts a rectangular microstrip antenna. Although the two most common element configurations are rectangular and round, the antenna itself may be square, rectangular, round, elliptical or other such geometrical shape. The microstrip antenna is well known and for example of such antennas reference is made to the text "Electronic Engineers Handbook 3$^{rd}$ Edition" by D. G. Fink et al. chapter 18 entitled "Antennas and Wave Propagation" pages18-40 to 18-44. The text shows microstrip antennas and the structures depicted in FIGS. 1*a* to 1*c* are taken from that text. See also a text entitled Broadband Microstrip Antennas by G. Kumar & K. P. Ray published by AirTech House (2003). See page 62 depicting series resonant patch antennas.

Referring to FIG. 1*c* there is shown a microstrip or patch antenna which employs a direct connection of a coaxial center conductor to a patch. Shown in FIG. 1*c* is a patch 14, which patch may be a metal patch positioned on the surface of a dielectric substrate 10. The substrate 10 may be a foam substrate of a given dielectric commonly employed in microstrip antennas. Connected to the patch is a center conductor 11 of coaxial cable. Also shown surrounding the center conductor 11, is a metallic outer shield or conductor 15 which may be connected to a ground plane. A second patch 17 is adjacent to patch 14 which also is directly connected to a center conductor 21 and surrounded by a metallic outer housing 18, which forms a coaxial device. The spacing 12 between the conductors and the outer shield may be a dielectric such as air or some other conventional dielectric material.

The substrate 10 may be a foam substrate having a dielectric constant $E_R$. Substrates made of foam or other substrates utilized in conjunction with microstrip patch antennas are well known and any such substrate can be employed.

FIG. 1*a* shows a circular or round microstrip antenna 20 and FIG. 1*b* shows a rectangular microstrip coaxial antenna 21. The dimensions such as a/3, W, and L indicated on the Figures are from the above-noted text. The text shows how those dimensions relate to the bandwidth, the impedance as well as the required dielectric thickness for square and round microstrip antennas. Essentially the charts in the text show the resonant size of the square microstrip as well as the resonant diameter of the round microstrip devices.

Figure 2:
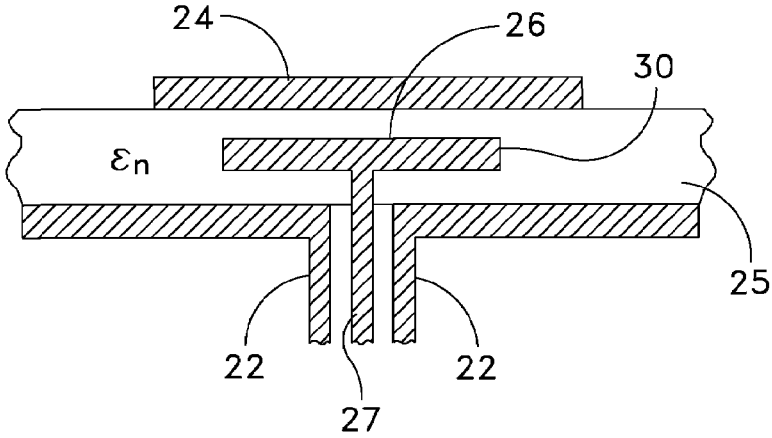
FIG. 2 (PRIOR ART)
FIG. 2 shows an alternate embodiment of a prior art coaxial microstrip antenna.

Referring to FIG. 2, there is shown the prior art technique of providing a microstrip antenna having a series resonance. As seen in FIG. 2, the center conductor 27 is not connected to the patch 24. Patch 24 is positioned on substrate 25 which has a selected dielectric constant. The center conductor 27 is positioned in the vicinity of the patch 24 and is coupled to the patch 24 via the capacitance between the center conductor 27 and a second patch or plate 30. The plate or patch 30 may or may not be included. In any event, the spacing between the patch 24 and the face of the conductor 30 constitutes a capacitance which capacitance appears in series with the inductance afforded by the coaxial cable. The center conductor 27 is also surrounded by a supporting metallic housing 22 which may constitute a ground plane as well. The structure depicted in FIG. 2 eliminates the direct connection of the conductor to the patch and uses an indirect connection with a series capacitance formed between the end of the center conductor 27 and the metal patch 24. A plate 30 may be mounted on the end of the center conductor 27, or the end of the center conductor may be of sufficient size at center or resonant frequency to provide the required series capacitance. There is a prior art structure using an "L" shaped plate connected to the conductor configuration and is referred to in the prior art as an L-probe. See the above noted text "Broadband Microstrip Antenna" FIG. 2.22(*d*). The result in this indirect connection compensated probe configuration is a series resonant circuit which is used to feed the metal patch antenna. One can employ multiple substrate layers with the plate embedded within the layers. The plate is mechanically inserted between the substrate layers and then coupled to the probe. This increases the mechanical complexity and provides for a less rugged structure.

Figure 3:
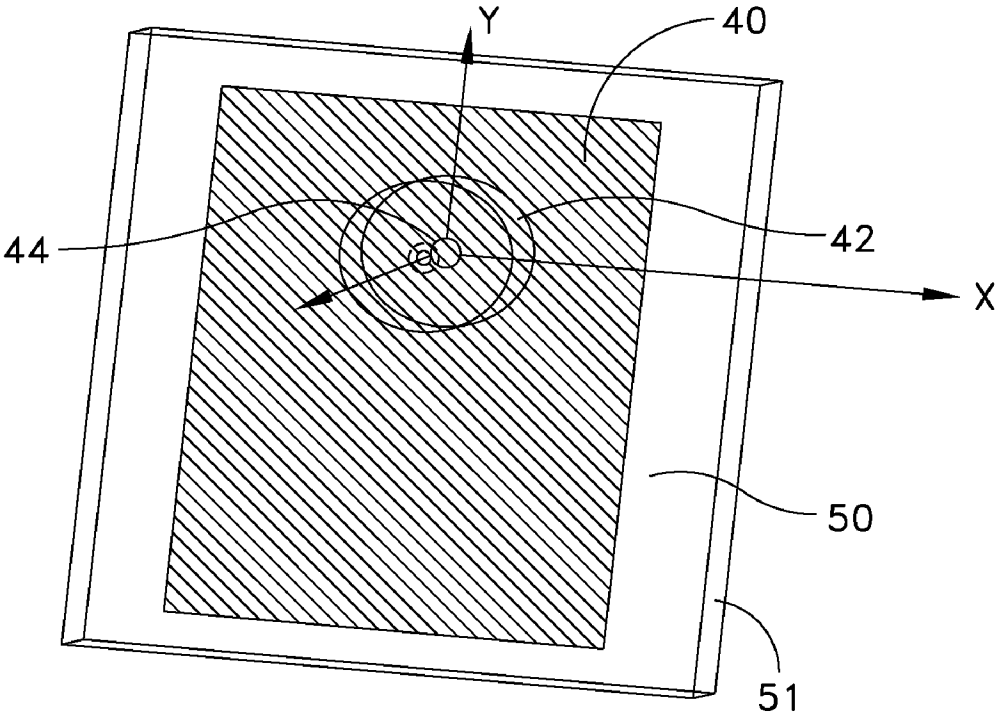
FIG. 3 shows a front elevational view of a microstrip antenna employing parallel tuning according to an embodiment of the invention.

Referring to FIG. 3, there is shown a microstrip antenna according to an embodiment of the present invention. A metal patch 40 is deposited or otherwise formed on the surface of a dielectric substrate 50. The dielectric substrate 50 has a ground plane 51 which is a metal coating disposed on the bottom surface (not shown) of the substrate 50. The dielectric substrate 50 may be a foam substrate, a Teflon substrate, or other known substrate type. Such substrates are widely employed in making microstrip antenna configurations. The metallic patch 40 may be a suitable metal such as copper, or a precious metal (e.g. for high frequency operation). A coaxial input cable has a center conductor 44 directly connected to the plate or patch 40. The center conductor 44 extends through the substrate 50 via a hole in the substrate 50. An outer conductor 42 is the outer housing of the coaxial cable within the substrate 50. The additional outer cylindrical metal housing 42 surrounds and is connected to the coaxial cable and basically operates to control or adjust the capacitance. A parallel capacitor is formed with one plate of the capacitor being the patch 40 which again is connected to the center conductor 44. The other plate of the capacitor is the front surface of the metal housing 42, which forms the second plate of the capacitor. The metal housing 42 surrounds and is connected to the coaxial conductor forming the outer conductor 41 (of FIG. 4), and basically operates to adjust the capacitance between the patch 40 and the plate formed by the front surface of the inner housing 42. As one can see in FIG. 7, there is a dielectric between the center conductor 44 of the coaxial input and the metal housing 42. This dielectric can be air, or can in fact be any suitable dielectric material such as a foam dielectric or other dielectric as known in the art.

Figure 4:
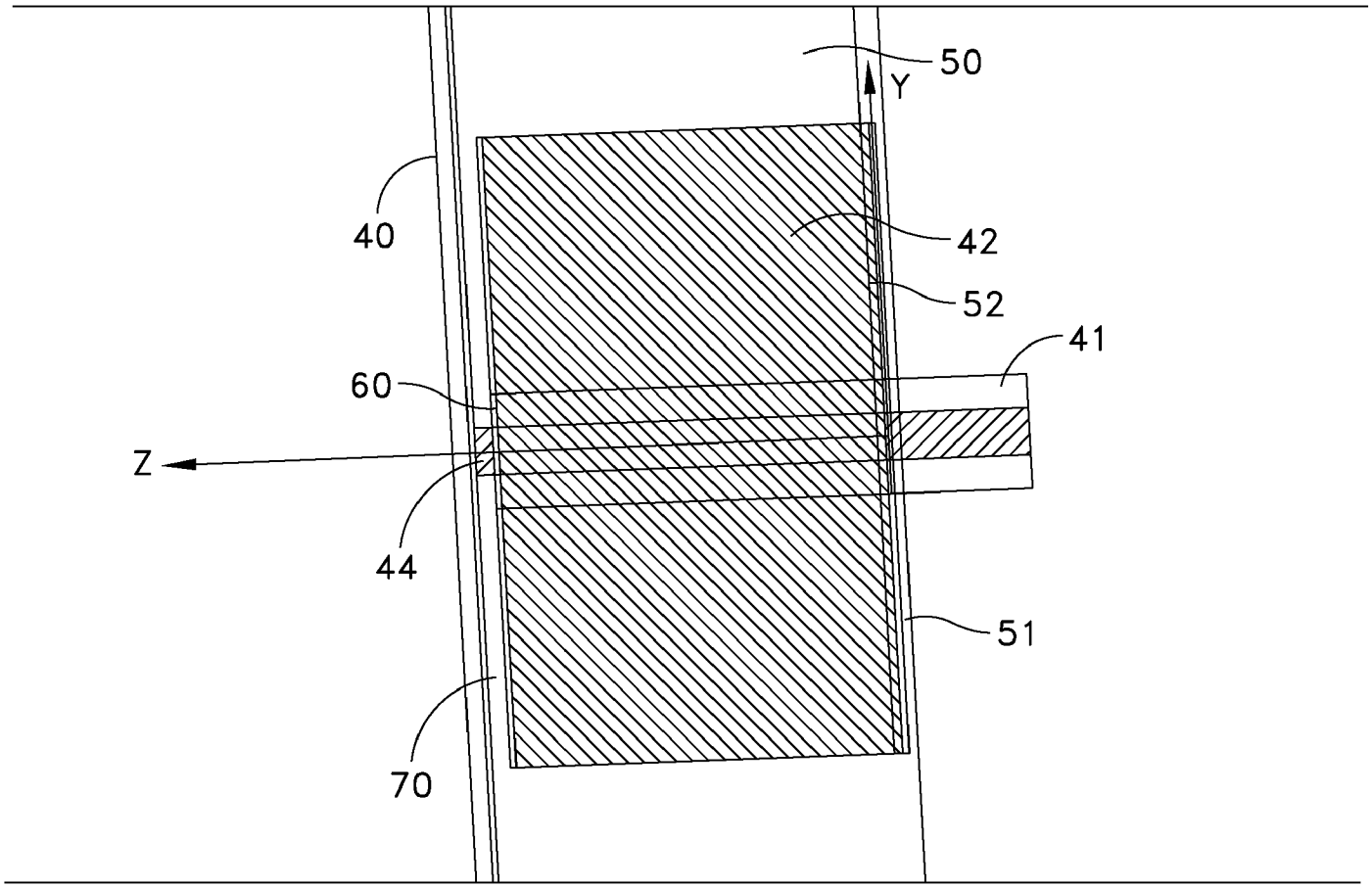
FIG. 4 shows a side view of the antenna of FIG. 3.

Referring to FIG. 4, there is shown a side-view of the microstrip antenna apparatus depicted in FIG. 3. The same reference numerals have been employed to denote similar operating parts. As seen in FIG. 4, the XYZ axes are shown; the same axes are shown in FIG. 3. In FIG. 4 the X axis is directed into the paper, while the Z axis is shown in the horizontal direction. The metal patch 40 is depicted and the center conductor 44 of the coaxial structure is connected directly to the metal patch or plate 40. The center conductor 44 is surrounded by an outer housing or conductive layer 42 within the substrate. The housings are concentric and essentially the outer metallic housing 42 is located only in the substrate. The outer housing 42 is depicted and as shown surrounds the inner conductor 44 inside the substrate only. Housing 42 back surface of which is metallic, is directly connected to ground plane 51. The first plate of the parallel capacitor is the patch 40 with the second plate of the capacitor being the front wall of the outer housing 42. The dimensions of the housing 42 determine the capacitance provided between the patch 40, which is the first plate of the capacitor and the second plate as determined by the front surface of housing 42.

There is also shown the ground plane 51 which is deposited on the back surface of the dielectric substrate 50. As seen in FIG. 4, the coaxial cable configuration which is mounted on the outside of the bottom surface of the microstrip's substrate ground plane 51 is extended into the substrate and the center conductor (or probe) is connected directly to the bottom surface of the metal patch 40. The length of the coaxial cable center conductor (or probe) which extends beyond the cable end to implement the direct connection to the bottom surface of the metal patch 40 is reduced due to it being surrounded by the metal housing 42. As a consequence, the series inductance of the center conductor (or probe) is reduced. However, an inductive input impedance still results from the center conductor (or probe) remaining series inductance. This inductance however, is smaller than the inductance for a direct connection as for example, shown in FIG. 1. The diameter of the housing 42 within the substrate can be increased to provide a larger surface 60. The center conductor structure is surrounded with the metal housing 42. The front surface 60 of the conductor forms a flat plate on the end of the coaxial cable. The flat plate is one plate of a parallel plate capacitor formed by its proximity to the metal patch or the other plate on the substrate top surface. The value of the capacitance can be adjusted by the area formed by the dielectric space and dielectric constant and the spacing between the plates. Thus, the microstrip patch antenna input impedance using a direct probe connection can be adjusted and centered on the 1+j0 on the Smith Chart at a desired design center frequency. As one can see, the enlarged outer housing 42 of the coaxial cable feed becomes an integral part of the normal outer support housing and constitutes a robust mechanical structure. This structure is shown in FIG. 3 wherein the inner conductor of the cable is surrounded by the larger outer housing 42.

The increased surface of the coaxial cable housing shown in FIG. 4 as 60 forms the second plate of the capacitor. The first plate of the capacitor is the metal patch 40. The spacing 70 between the patch 40 and the surface of the conductor 60 determines the value of the capacitor. As one can understand, the enlarged outer housing of the coaxial cable feed as shown in FIGS. 3 and 4 is an integral part of the outer housing and constitutes a robust mechanical structure. The prior art series compensating configurations require plates mounted on the slender diameter center conductor of the coaxial cable and insertion within the substrate material. The enlarged outer housing 42 can be directly inserted into the substrate material via a machined circular hole of appropriate depth to form the parallel plate capacitor. In any event, a plate can also be formed by employing a front wall of the surrounding metal cylinder 42. While the housing configuration 42 depicted and shown for example in FIG. 3 depicts a circular configuration it is understood that any geometrical configuration can be employed, such as rectangular, octagonal, hexagonal and so on. The main purpose of the housing 42 is to surround the center conductor of the coaxial cable only within the substrate therefore enabling an effective plate to be formed by the front surface of the housing 42 structure.

Figure 5:
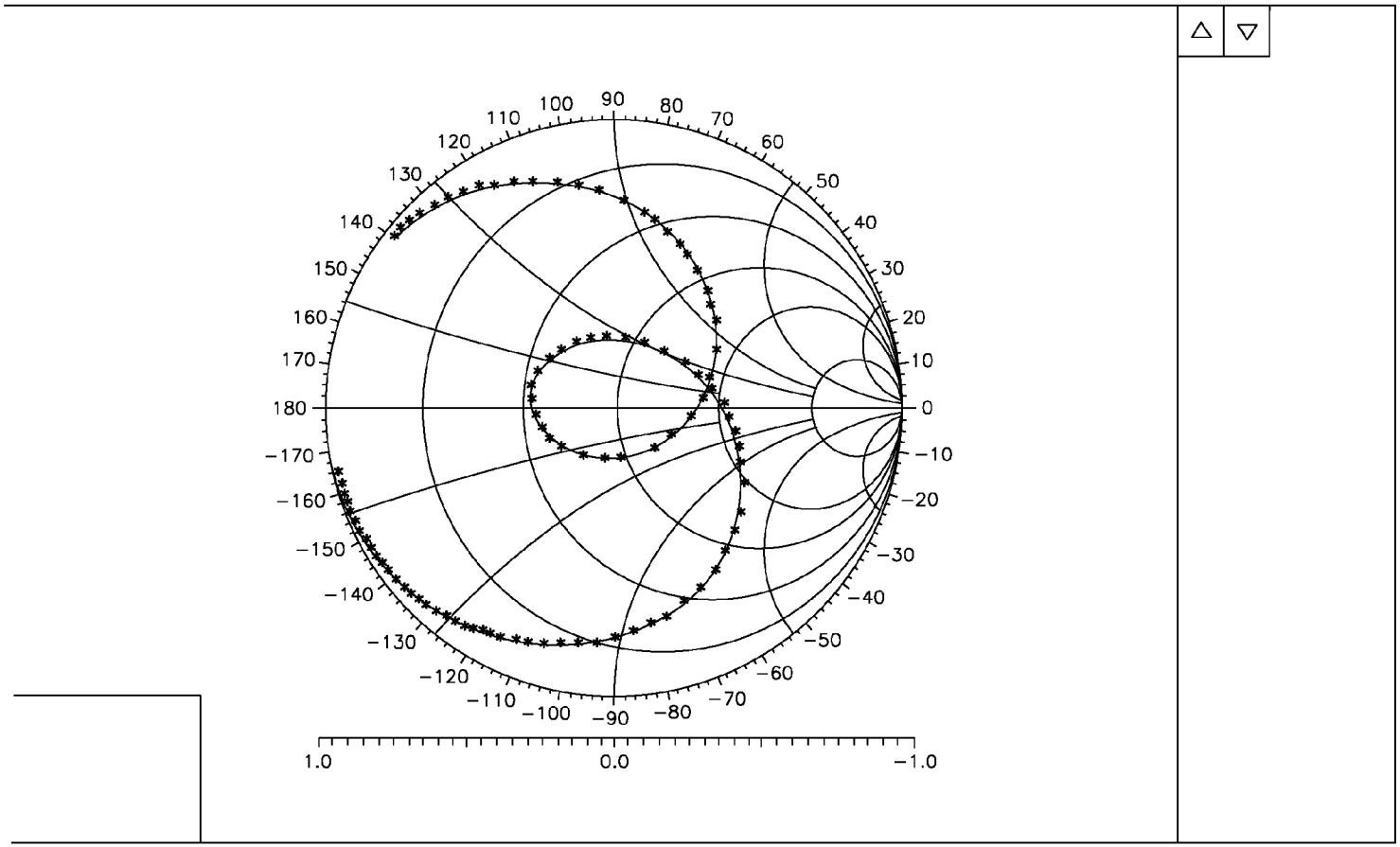
FIG. 5 depicts a Smith Chart showing the ability to obtain impedance match using the configurations and structures according to aspects of the invention.

The Smith Chart depicted in FIG. 5 shows the simulations which are applied to stack patch antenna elements according to this invention and showing the result in impedance match which can be formed by the structure of this invention. The present physical configuration employs a 50 ohm coaxial feed line and has no other electrical input impedance matching structures. In this manner the number of drawings and associated lifetime costs for drawing support are reduced. The physical feed and element structure according to this invention has demonstrated that tight tolerances on nearly all physical dimensions and corresponding dielectric material properties are not required. Thus the invention reduces element complexity/costs, while improving manufacturability. The reduced mechanical/electrical complexity means larger array electromagnetic simulations are possible. This is advantageous in designing finite size phased array antennas for radar and other systems. The technique will scale with frequency and this can be adapted to a wide spectrum of platforms and future applications. Based on the location of the large metallic housing, one there obtains improved element structure with an electrically robust structure for high transmission power. Thus the configuration depicted is less susceptible to breakdowns with voltage.

Figure 6:
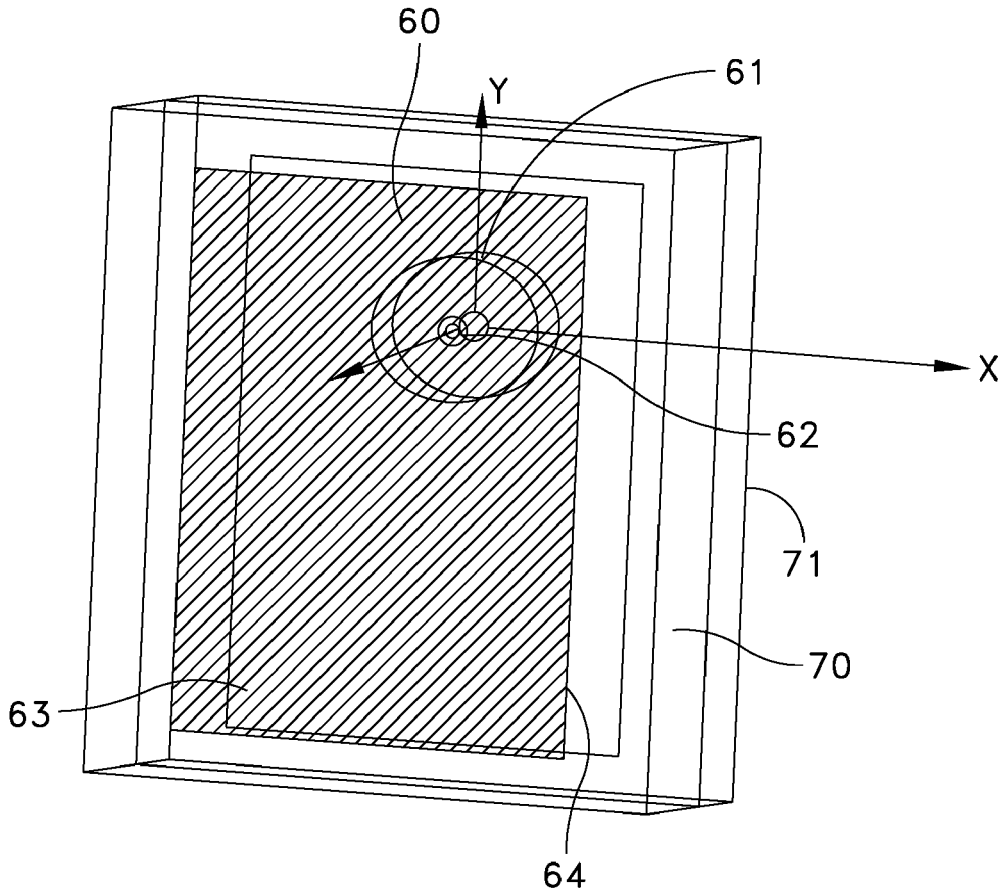
FIG. 6 shows a micro-strip antenna employed in a stacked patch antenna array according to an embodiment of the invention.

Referring to FIG. 6, there is shown a stacked patch element array. Again the coaxial cable has the center conductor 62 which is centered within a large outer housing 60 forming an outer housing structure for the coaxial cable. The spacing between the outer housing 60 and the center conductor 62 contains a dielectric material and a preferred embodiment is air. A metal patch 63 is disposed upon the surface of the dielectric substrate 64. FIG. 6 shows that the patches can be stacked, one above the other and have various different substrate structures such as 70 and 71 positioned one above the other to obtain a number of stacked elements. Essentially, as indicated above, one uses an extension of the external connector housing which is the 50 ohm coaxial transmission feed line. This housing structure is directed through the ground plane on the underside of the substrate into the patch element substrate structure to both control the value of the series shunt probe inductance while concurrently forming a parallel plate capacitance which is indicative of the front surface of the surrounding housing. The series probe feed inductance and the parallel plate capacitance result in a shunt/parallel tuning circuit structure. The proximity of the coaxial outer housing and its surface area is adjusted to obtain the capacitance required for parallel resonance. The use of parallel resonance is superior to series resonance as it provides for a much wider range of tuning and so on.

Figure 7:
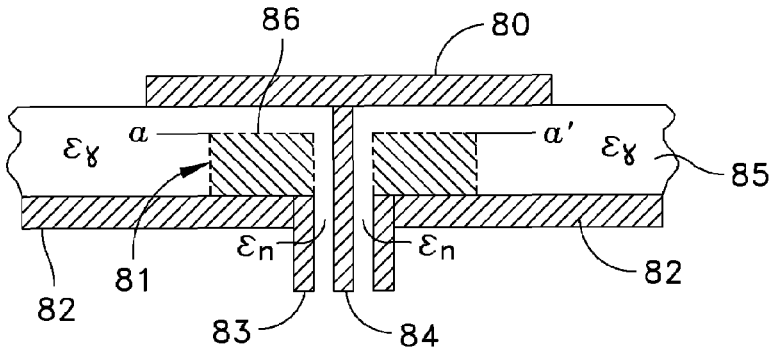
FIG. 7 is a cross-sectional view of a single driven patch with open sides having a surrounding metal cylinder around coaxial structure within substrate.

Referring to FIG. 7 there is shown a cross-sectional view of the patch antenna configuration depicted in FIG. 3 and FIG. 4. As seen, a metallic patch 80 is positioned on the top surface of a dielectric layer 85. The center conductor 84 of a coaxial cable is directly connected to the patch 80. The ground plane 82 is shown and the outer conductor 83 of the coaxial cable which is an outer shield or outer housing and is metal, is directly connected to the metal ground plane. Positioned on and attached to the ground plane 82 is a surrounding cylindrical metal solid outer housing 81. The housing 81 is positioned within the substrate 85 and is directly connected to the ground plane 82. Thus, as one can see from FIG. 7, the metal patch 80 which is disposed on a top surface of the substrate 85 is directly driven by the coaxial center conductor 84. The top surface 86 of the metal solid housing 81 and the lower surface of the driven patch 80 form a parallel plate shunt capacitance acting on input impedance which is seen at the reference plane a-a'.

Figure 8:
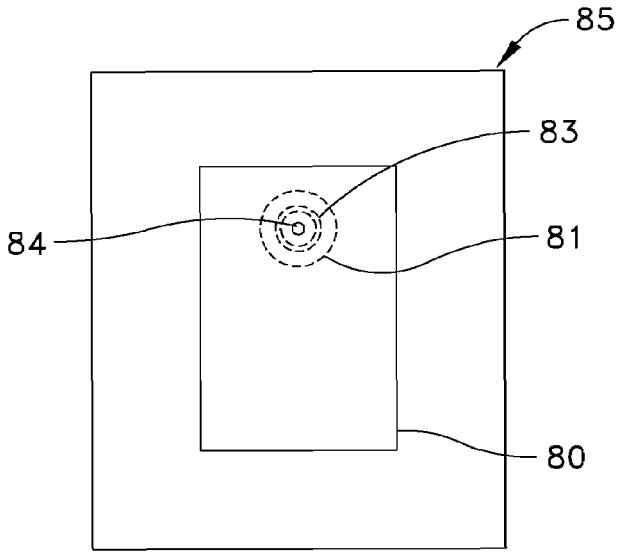
FIG. 8 is a front view of a single driven patch rectangular module with linear polarization.

Referring to FIG. 8 there is shown a front view of the single driven patch 80 depicted in FIG. 7, utilizing like reference numerals. The substrate 85 has a metal ground plane on the back side which is not shown. The coaxial cable is shown with center conductor 84 and shield 83 and with the metal housing 81 surrounding the coaxial cable.

Figure 9:
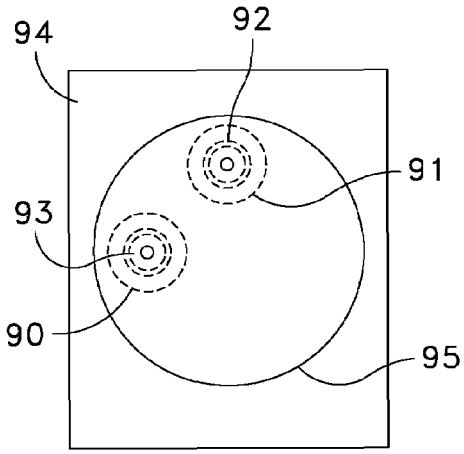
FIG. 9 is a front view showing a dual linear polarization/or circular polarization with a single driven circular configuration.

Referring to FIG. 9 there is shown a front view employing two input connections at orthogonal locations. The structure depicted in FIG. 9 provides a dual linear polarization/or circular polarization. As seen in FIG. 9, there is a circular patch 95 which is disposed on the top surface of the substrate 94. Located within the substrate is a first coaxial cable input 93 and a second coaxial cable input 92. The coaxial cable input 93 is associated with the surrounding metal housing 90 while the coaxial cable input 92 is associated with a surrounding metal housing 91. Both metal housings 90 and 91 are connected to the ground plane which is disposed on a back side of the substrate 94 and is not shown. Essentially the configuration shown in FIG. 9 consisting of the coaxial cable input 92 and 93 are the same configurations depicted in FIG. 7. The coaxial cables are located at orthogonal locations and are capable of providing dual linear polarization and/or circular polarization.

Figure 10:
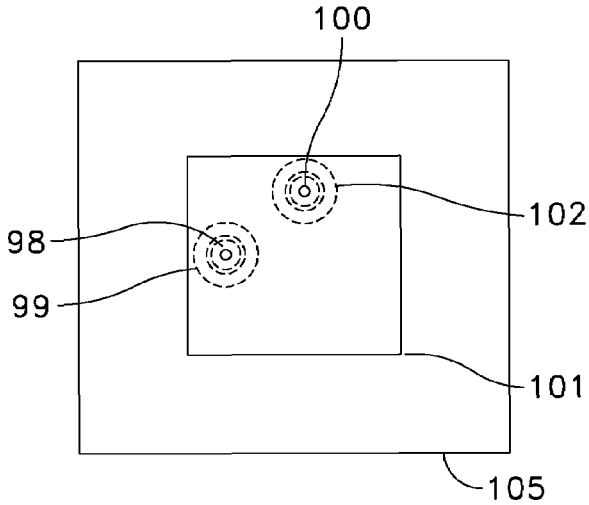
FIG. 10 is a front view showing dual linear polarization/or circular polarization by employing a single driven square patch configuration.

Referring to FIG. 10 there is shown a front view of a single driven square patch element having two input connections at orthogonal locations. The structure depicted in FIG. 10 is capable of providing dual linear polarization/or circular polarization. As seen in FIG. 10 there is a square metal patch 101 which is disposed on the top surface of the substrate 105. The substrate 105 has a bottom surface containing a metallized ground plane which is not shown. Located within the substrate is a first coaxial cable input 100 and a second coaxial cable input 98. Both coaxial cables are surrounded by metallic housings 102 and 99 as of the format depicted in FIG. 7.

Figure 11:
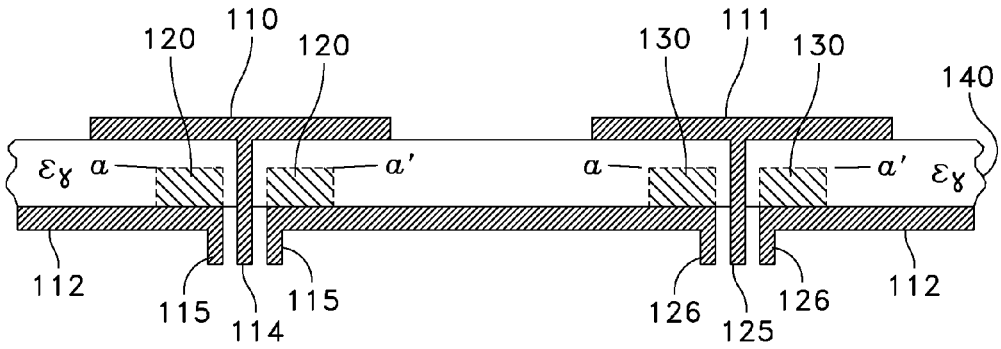
FIG. 11 is a cross-sectional view of two driven patches employing surrounding metal cylinders.

Referring to FIG. 11, there is shown a cross-sectional view of two driven patches disposed upon a substrate 140. As seen in FIG. 11 the substrate 140 again is a dielectric substrate and has disposed thereon a first patch 110 and a second patch 111. Each patch is connected to a center conductor of a coaxial cable. Thus patch 110 is connected to center conductor 114 of coaxial cable. The coaxial cable shield 115 is directly connected to the ground plane 112. The patch 111 is directly connected to the center conductor of a second coaxial cable. The center conductor 125 of the coaxial cable is directly connected to the metallic patch 111. The shield or outer housing 126 of the coaxial conductor is connected to the ground plane 112, while the center conductor 125 is surrounded by the metallic housing 130. The center conductor 114 associated with shield 115 is surrounded by a metallic housing 120. The metallic housings 120 and 130 operate as the metallic housing depicted in the above noted Figures and operate to form a parallel resonant circuit for the coaxial cable. The configuration depicted in FIG. 11 can be utilized in an antenna array and as depicted the array spacing would be from center conductor 114 to center conductor 125. It is of course understood that many more elements can be formed on the substrate thus making for extremely large arrays. This configuration is useful in phased array antennas, or in antenna configurations for radar or communication systems.

Figure 12:
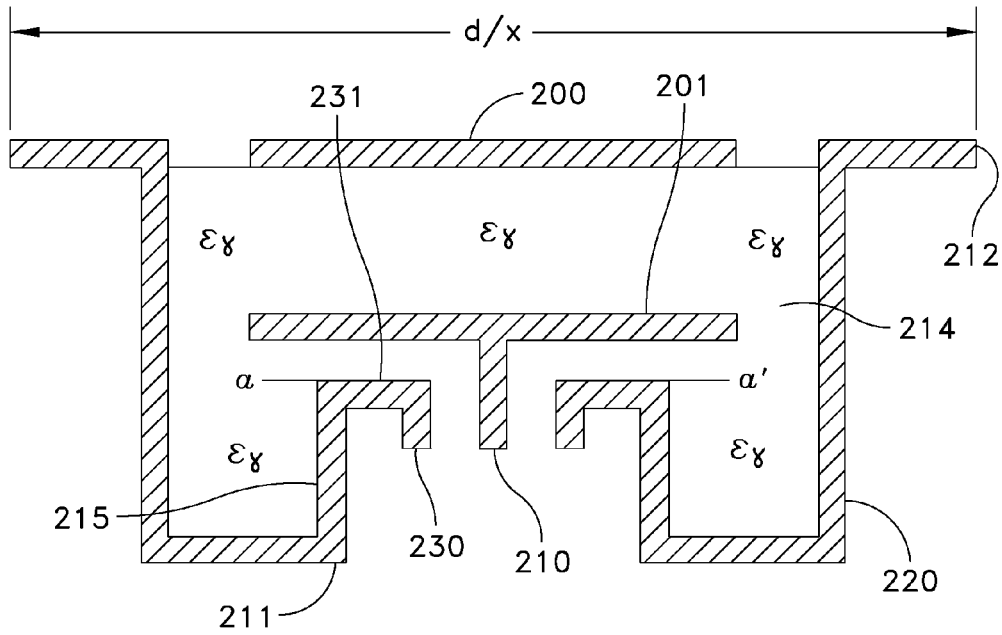
FIG. 12 is a cross-sectional view depicting two stacked patch antenna elements positioned in a single cavity mount with surrounding metal sidewalls.

Referring to FIG. 12 there is shown a two patch antenna element array. As seen in FIG. 12 the array is associated with an integral hollow metal housing 215. The metal housing 215 has extending walls as 212 which can be connected to another housing. There is shown a dielectric substrate 214. Disposed on the top surface of the dielectric substrate 214 is a parasitic patch 200. As seen the parasitic patch is disposed on a top surface of the substrate 214. Positioned below the parasitic patch is a second metallic patch 201. The patch 201 is a driven patch and has the center conductor 210 of a coaxial cable connected directly thereto. The metal housing 215 has extending L-shape top walls 231 which have end flanges as 230 to provide a metallic surrounding for the center conductor 210. The metallic surround formed by extensions 230 operates as the metallic wall described above. In any event, in the configuration shown in FIG. 2 the driven patch 201 is directly connected to the center conductor 210 of the coaxial cable. The patch 200 which is on the top surface of the substrate is not connected to the center conductor but is positioned above the plate 201. In any event the surrounding metallic walls 231 operate to form a parallel capacitance which is in parallel with the inductance formed by cable 230. The parasitic patch is coupled to the driven patch capacitively. The metal sidewalls as 220 reduce mutual coupling and the propagation of surface waves. The utilization of surrounding metal walls to do this has been employed in direct connected devices but the metallic walls as present herein operate to provide a parallel capacitance between driven patch 201 and surface 231. The cavity shape can be rectangular, square, circular and so on and can be basically of any suitable geometric shape to accommodate the patch geometries. The dimension $d/\lambda$ is the unit cell size in an array. Thus the configuration in FIG. 12 can be again employed in a stacked array which has two patch antenna elements as 200 and 201.

Many other alternative embodiments will become clear to one skilled in the art all such alternate embodiments as well as alternate techniques are deemed to be encompassed within the spirit and scope of the claims appended hereto.

What is claimed is:

1. A patch antenna element, comprising:

a substrate having a top and bottom surface, a metal patch area positioned on the top surface of said substrate, said patch providing a first capacitor plate, a coaxial cable structure directed through said substrate and having a center conductor connected to said metal patch, a conductive housing surrounding said coaxial cable structure within said substrate, with a surface of said housing positioned in proximity to said patch area to form a second capacitor plate, wherein said resultant capacitor formed by said first and second plates is in parallel with the sum of series inductance provided by said coaxial cable structure within said substrate plus input impedance of driven patch.

2. The patch antenna element according to claim 1, wherein said substrate is a foam substrate.

3. The patch antenna element according to claim 1, wherein said coaxial cable structure is selected to be circular or rectangular.

4. The patch antenna element according to claim 1, wherein said substrate has the bottom surface metallized to form a ground plane and wherein said conductive housing is connected to said ground plane.

5. The patch antenna element according to claim 1, wherein said conductive housing is metal.

6. The patch antenna element according to claim 1, wherein said conductive housing is circular.

7. The patch antenna element according to claim 1, wherein said conductive housing is rectangular.

8. The patch antenna element according to claim 1, wherein said conductive housing is elliptical.

9. The patch antenna element according to claim 1, further including a dielectric material surrounding said coaxial cable and located between the inner wall of said conductive housing and the center conductor of said coaxial cable.

10. The patch antenna element according to claim 9, wherein said dielectric is air.

11. A patch antenna comprising:

a substrate having a top and a bottom surface, a metal patch positioned on said top surface of said substrate, a coaxial cable structure directed through said substrate with the center conductor of said coaxial cable connected to said patch said coaxial structure center conductor probe having a given inductance, and a housing positioned about said coaxial structure within said substrate to form a parallel capacitance with said patch and with the patch input impedance in series with the inductance of said coaxial cable structure within said substrate to cause a parallel resonance.

12. The patch antenna according to claim 11, wherein said housing surrounds said center conductor of said coaxial cable and is a conductive housing.

13. The patch antenna according to claim 12, wherein the space between said center conductor and said housing is filled with a dielectric material.

14. The patch antenna according to claim 13, wherein said dielectric is air.

15. The patch antenna according to claim 11, wherein said housing is a circular metal housing having a top with an opening to enable said center conductor to pass through and with said housing surface being a capacitor plate, with said patch being the other plate.

16. The patch antenna according to claim 11, wherein said coaxial cable structure is selected from one of the following a square, rectangular, round and elliptical configuration.

17. The patch antenna according to claim 11, wherein said housing is a circular metal housing.

18. The patch antenna according to claim 11, wherein said housing is a rectangular metal housing.

19. The patch antenna according to claim 11, wherein said substrate is a foam substrate.

20. A patch antenna comprising:

a substrate having a top and bottom surface, a first metal patch positioned on the top surface of said substrate, a second metal patch positioned within said substrate and below said top surface, a coaxial cable structure directed through said substrate and having a center conductor connected to said second metal patch, a conductive housing surrounding said coaxial cable structure within said substrate, with a surface of said housing positioned in close proximity to said second metal patch to form a capacitor plate with the other plate formed by said first and second patches wherein the resultant capacitor formed is in parallel with the sum of series inductance provided by said coaxial structure within said substrate, and the driven patch input impedance.

* * * * *